US009786231B2

(12) United States Patent
Matsui

(10) Patent No.: US 9,786,231 B2
(45) Date of Patent: Oct. 10, 2017

(54) DISPLAY DEVICE FOR VARYING THE DRIVING FREQUENCY OF A BACKLIGHT AND DRIVING METHOD THEREOF

(71) Applicant: NEC Display Solutions, Ltd., Tokyo (JP)

(72) Inventor: Katsuyuki Matsui, Tokyo (JP)

(73) Assignee: NEC DISPLAY SOLUTIONS, LTD., Tokyo (JP)

( * ) Notice: Subject to any disclaimer, the term of this patent is extended or adjusted under 35 U.S.C. 154(b) by 0 days.

(21) Appl. No.: 14/894,468

(22) PCT Filed: May 29, 2013

(86) PCT No.: PCT/JP2013/064917

§ 371 (c)(1),
(2) Date: Nov. 27, 2015

(87) PCT Pub. No.: WO2014/192099

PCT Pub. Date: Dec. 4, 2014

(65) Prior Publication Data

US 2016/0117997 A1 Apr. 28, 2016

(51) Int. Cl.

| | |
|---|---|
| ***G09G 3/36*** | (2006.01) |
| ***G09G 3/34*** | (2006.01) |
| ***H05B 33/08*** | (2006.01) |
| ***G09G 3/32*** | (2016.01) |

(52) U.S. Cl.

CPC ..... *G09G 3/3406* (2013.01); *G09G 3/32* (2013.01); *G09G 3/36* (2013.01); *H05B 33/0845* (2013.01); *G09G 2320/064* (2013.01)

(58) Field of Classification Search

CPC ..... G09G 3/3406

USPC ..... 345/102

See application file for complete search history.

(56) References Cited

U.S. PATENT DOCUMENTS

2007/0257869 A1* 11/2007 Huang ..... G09G 3/3406 345/82
2010/0020108 A1* 1/2010 Cho ..... G09G 3/3406 345/690
2013/0321254 A1* 12/2013 Kim ..... G09G 3/36 345/102

(Continued)

FOREIGN PATENT DOCUMENTS

| | | |
|---|---|---|
| JP | H 11-196579 A | 7/1999 |
| JP | 2002-324685 A | 11/2002 |
| JP | 2008-198430 A | 8/2008 |

OTHER PUBLICATIONS

International Search Report in PCT/JP2013/064917 dated Aug. 27, 2013 with an English Translation thereof.

(Continued)

*Primary Examiner* — Long D Pham
(74) *Attorney, Agent, or Firm* — McGinn IP Law Group, PLLC

(57) ABSTRACT

A display device includes a drive control unit that changes a frequency of a drive signal based on a brightness of a light source of a backlight when a duty ratio of the drive signal is in a first range or is in a third range, the drive signal being a pulse signal for driving the light source. The drive control unit fixes the frequency of the drive signal to a predetermined frequency when the duty ratio of the drive signal is in a second range.

8 Claims, 7 Drawing Sheets

(56) References Cited

U.S. PATENT DOCUMENTS

2013/0321484 A1* 12/2013 Kim ..... G09G 3/3233
345/690

OTHER PUBLICATIONS

"Regarding enforcement of revision of Government and Ministerialordinance of Electrical Appliance and Material Safety Law", Product Safety Division, Commerce and Distribution Policy Group,Ministry of Economy, Trade and Industry, May, Heisei 24 (web search in May 8, 2013) with a partial English translation thereof.

* cited by examiner

DISPLAY DEVICE FOR VARYING THE DRIVING FREQUENCY OF A BACKLIGHT AND DRIVING METHOD THEREOF

TECHNICAL FIELD

The present invention relates to a display device and a display device control method.

BACKGROUND ART

A liquid crystal display device is configured by a liquid crystal layer, a backlight device, and the like. The backlight device in such a liquid crystal display device includes a device using white light. Moreover, a recent backlight device uses an LED (light-emitting diode) as a light source thereof.

When the LED is used as the light source of the backlight device of the liquid crystal display device, the LED is driven by, for example, PWM (Pulse Width Modulation) (for example, refer to Patent Document 1). In the PWM drive, a pulse width to be input to the LED is controlled to control brightness of the LED, that is, brightness of the backlight to be used as the light source.

Moreover, an afterimage time of the LED is shorter than that of a fluorescent tube conventionally used as the light source. Therefore, in a lighting device using the LED, standards for preventing a feeling of unwellness or the like of a user due to flicker of light output are defined (for example, refer to Non-Patent Document 1). In the standards, a technical criterion that the user does not feel flicker of light output is defined. In Non-Patent Document 1, it is described that one having a repetition frequency of 100 [Hz] or higher and no missing part in the light output, or one having a repetition frequency of 500 [Hz] or higher, is construed as "no sense of flicker". Accordingly, in the backlight device using the LED, when control by the drive of the PWM (hereinafter, referred to as "PWM drive") is executed, if the repetition frequency is low, it is considered that flicker similar to that of an LED lighting device occurs. Therefore, in order to reduce flicker in the backlight device using the LED, the repetition frequency in the PWM drive needs to be increased.

PRIOR ART DOCUMENT

Patent Document

[Patent Document 1] Japanese Unexamined Patent Application, First Publication No. 2002-324685

Non-Patent Document 1 http://www.meti.go.jp/policy/consumer/seian/denan/kaisei_setsumeikai201205.pdf, "Regarding enforcement of revision of Government and Ministerial ordinance of Electrical Appliance and Material Safety Law",
Product Safety Division, Commerce and Distribution Policy Group, Ministry of Economy, Trade and Industry, May, Heisei 24 (web search in May 8, 2013).

SUMMARY OF THE INVENTION

Problem to be Solved by the Invention

However, if the frequency to drive the LED by the PWM is increased in order to reduce flicker, the period of an on state or off state of the LED to be controlled for adjusting brightness is limited by the drive circuit that drives the LED. Hence, there has been a problem in that the range of brightness of an image that can be displayed on a display device incorporating an LED as the backlight is limited.

In view of the above situation, it is an exemplary object of the present invention to provide a display device and a display device control method that can improve the range of displayable brightness in a display device incorporating a backlight device that uses an LED as a light source.

Means for Solving the Problem

In order to achieve the above object, a display device according to the present invention includes: a drive control unit that changes a frequency of a drive signal based on a brightness of a light source in a first range in which a ranges of a duty ratio of the drive signal and a preset third range, the drive signal being a pulse signal for driving the light source of a backlight, the drive control unit fixing the frequency of the drive signal to a predetermined frequency in a second range in which the range of the duty ratio of the drive signal is preset.

In order to achieve the above object, a display device control method according to the present invention includes the steps of: changing a frequency of a drive signal based on a brightness of a light source in a first range in which a ranges of a duty ratio of the drive signal and a preset third range, the drive signal being a pulse signal for driving the light source of a backlight; and fixing the frequency of the drive signal to a predetermined frequency in a second range in which the range of the duty ratio of the drive signal is preset.

Effect of the Invention

The display device of the present invention can improve the brightness range that can be displayed on a display device incorporating a backlight device that uses an LED as a light source.

EMBODIMENTS FOR CARRYING OUT THE INVENTION

First Exemplary Embodiment

Exemplary embodiments of the present invention will be described in detail with reference to the drawings.

Figure 1:
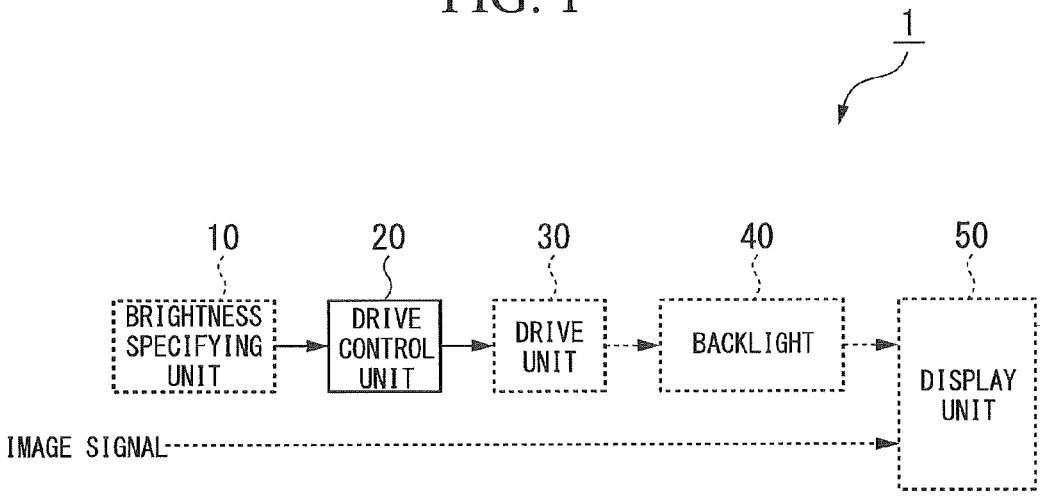
FIG. 1 is a block diagram of a schematic configuration of a display device according to a first exemplary embodiment.

FIG. 1 is a block diagram of a schematic configuration of a display device 1 according to the present exemplary embodiment. As shown in FIG. 1, the display device 1 includes a brightness specifying unit 10, a drive control unit 20, a drive unit 30, a backlight 40, and a display unit 50.

The brightness specifying unit 10 receives brightness (brightness) specified by a user, and outputs information indicating received brightness (hereinafter, referred to as "brightness information") to the drive control unit 20. The brightness specifying unit 10 outputs a duty cycle, being an on time of PWM (Pulse Width Modulation) corresponding to the specified brightness, as the brightness information to the drive control unit 20. Hereunder, the duty cycle is referred to as a duty ratio. For example, the brightness specifying unit 10 includes a switch or a remote-control light receiving unit provided in a body.

If the display unit 50 includes a sensor that measures brightness, the brightness information output by the brightness specifying unit 10 may be the duty ratio for maintaining a measurement value of the brightness measured by the sensor at the brightness specified by the user. Moreover, the sensor may be attached to the display unit 50 only when the brightness is measured. A timing for measuring the brightness by the sensor may be a predetermined cycle, a predetermined date and time, at random, at a time specified by the user, or the like. The brightness information is a target value including the brightness of a light source of the backlight 40, and may be the brightness specified by the user or the brightness measured by the sensor.

The drive control unit 20 acquires the brightness information output by the brightness specifying unit 10, and generates a drive signal for driving the backlight 40 by the PWM (hereinafter, referred to as "PWM drive") based on the acquired brightness information, and outputs the generated drive signal to the drive unit 30. The PWM drive may be current drive or voltage drive.

The drive unit 30 drives the backlight 40 corresponding to the drive signal generated by the drive control unit 20.

The backlight 40 is configured by a white LED (light-emitting diode), and emits light according to the drive signal output by the drive unit 30. For example, the backlight 40 is attached to a back surface of the display unit 50. Alternatively, the backlight 40 is attached to a lower part of the display unit 50, and emitted light is diffused by a light guide plate, a light diffusion film, and the like inside the display unit 50.

The display unit 50 is formed of a display such as a liquid crystal display, and displays an image signal input to the display device 1, on the display. The display unit 50 includes an image processing unit for displaying the input image signal on the display. The image signal is supplied from an image output device such as a PC (personal computer).

Figure 2:
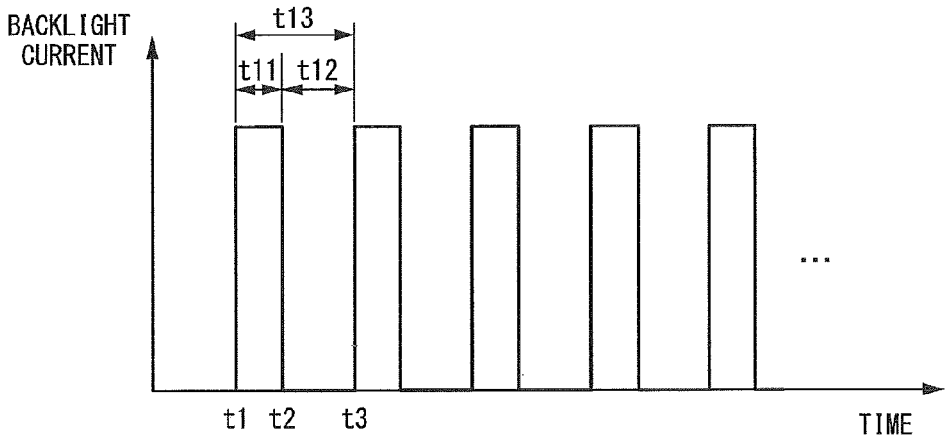
FIG. 2 is a diagram for explaining of a drive signal output to a drive unit by a drive control unit according to the first exemplary embodiment.

FIG. 2 is a diagram for explaining the drive signal output by the drive control unit 20 to the drive unit 30 according to the present exemplary embodiment. In FIG. 2, time is plotted on the horizontal axis, and current of the drive signal (also referred to as "backlight current") is plotted on the vertical axis. A period during which the drive signal is at a high level is referred to as an on state, and a period during which the drive signal is at a low level is referred to as an off state.

In FIG. 2, a period t11 from time t1 to time t2 is a period during which the pulse in the PWM drive is in the on state (hereinafter, also referred to as "on time"). A period t12 from time t2 to time t3 is a period during which the pulse is in the off state (hereinafter, also referred to as "off time"). A period t13, being a total period of the period t11 and the period t12 is one cycle in a pulse waveform (hereinafter, referred to as "PWM cycle"). For example, when the period t11 is 5 [μsec] and the period t12 is 45 [μsec], the PWM cycle t13 is 50 [μsec] (=5+45), and the duty ratio is 10% (=5/50×100). In the description below, the reciprocal of the PWM cycle is referred to as "PWM frequency". In the example in FIG. 2, the PWM frequency is 20 kHz (=1/50 [μsec]). Moreover, the pulse waveform in the PWM drive is referred to as "PWM waveform".

When the LED of the backlight 40 is to be driven by using the PWM waveform as shown in FIG. 2, if the PWM frequency is equal to or larger than a predetermined frequency, flicker is reduced. Moreover, the brightness of the LED of the backlight 40 can be changed by changing the length of the on time. The brightness of the LED of the backlight 40 increases as the on time becomes longer, and the brightness of the LED decreases as the one time becomes shorter.

Figure 3:
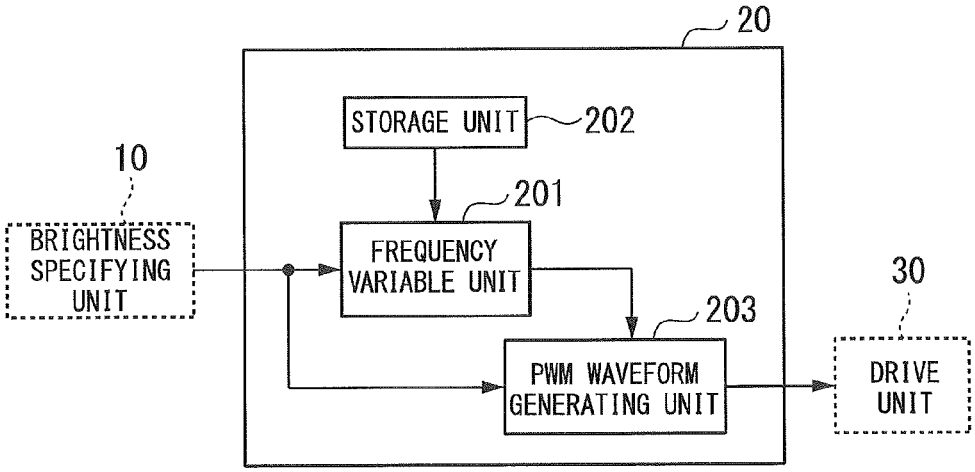
FIG. 3 is a block diagram of a schematic configuration of the drive control unit according to the first exemplary embodiment.

FIG. 3 is a block diagram of a schematic configuration of the drive control unit 20 according to the present exemplary embodiment. As shown in FIG. 2, the drive control unit 20 includes a frequency variable unit 201, a storage unit 202, and a PWM waveform generating unit 203.

The storage unit 202 stores a minimum on time, a minimum off time, a maximum frequency of the PWM frequency, and PWM variable characteristics. The PWM variable characteristics will be described later. The minimum on time and the minimum off time are values determined based on, for example, a minimum pulse width that can be driven by the drive unit 30 or a minimum pulse width that can be input to the backlight 40. Moreover, the maximum frequency of the PWM frequency is a value determined based on the maximum frequency that can be driven by the drive unit 30 or the maximum frequency that can be input to the backlight 40.

The frequency variable unit 201 acquires the brightness information output by the brightness specifying unit 10. The frequency variable unit 201 discriminates in which range of the duty ratio the acquired brightness information is, by using the PWM variable characteristics stored in the storage unit 202. The range of the duty ratio will be described later. The frequency variable unit 201 determines time information for generating the PWM waveform based on the discrimination result, and outputs the determined time information to the PWM waveform generating unit 203. The time information output by the frequency variable unit 201 is any one of the following three pieces of information (1) to (3):

(1) Information indicating usage of the minimum on time as the on time;

(2) Information indicating usage of the brightness information as the on time; and (3) Information indicating usage of the minimum off time as the off time.

Moreover, the frequency variable unit 201 selects the PWM frequency based on the PWM variable characteristics stored in the storage unit 202, and outputs the selected PWM frequency to the PWM waveform generating unit 203.

The PWM waveform generating unit 203 acquires the brightness information output by the brightness specifying unit 10. The PWM waveform generating unit 203 generates a drive signal based on the acquired brightness information, and the time information and the PWM frequency output by the frequency variable unit 201, and outputs the generated drive signal to the drive unit 30. If the time information is the information indicating usage of the minimum on time as the on time, the PWM waveform generating unit 203 generates a drive signal that maintains the minimum on time and has a PWM frequency cycle. Moreover, if the time information is the information indicating usage of the brightness information as the on time, the PWM waveform generating unit 203 generates a drive signal having the on time corresponding to the duty ratio of the brightness information and having a PWM frequency cycle. Alternatively, if the time information is the information indicating usage of the minimum off time as the off time, the PWM waveform generating unit 203 generates a drive signal that maintains the minimum off time and has a PWM frequency cycle.

Figure 4:
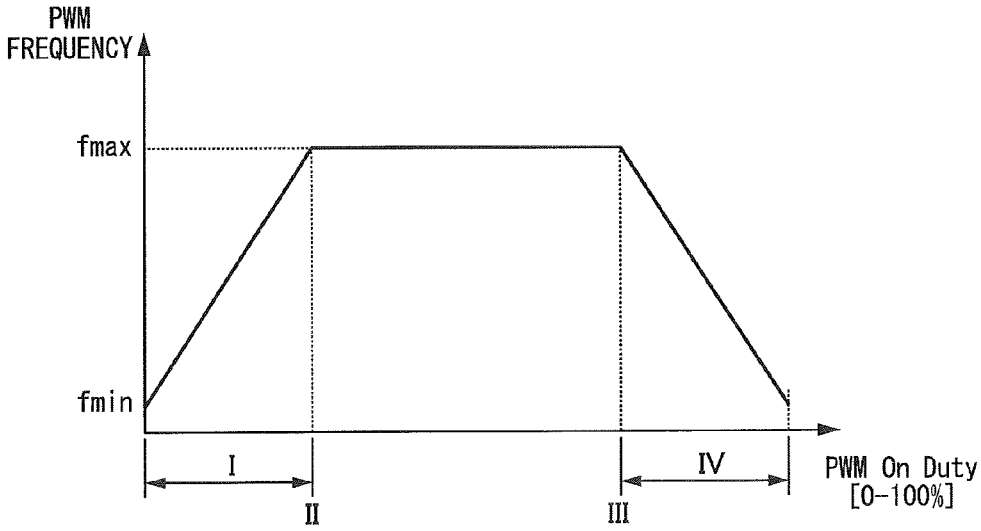
FIG. 4 is a diagram for explaining of an example of PWM variable characteristics stored in a storage unit according to the first exemplary embodiment.

Here, an example of the PWM variable characteristics stored in the storage unit 202 is described. FIG. 4 is a diagram for explaining an example of the PWM variable characteristics stored in the storage unit 202 according to the present exemplary embodiment. In FIG. 4, the duty ratio in the on state in the PWM waveform (also referred to as "PWM On Duty") is plotted on the horizontal axis, and the PWM frequency is plotted on the vertical axis. In the PWM On Duty on the horizontal axis, the left side is 0% and the right side is 100%.

In FIG. 4, the duty ratio II represents the PWM On Duty corresponding to the minimum on time, and the duty ratio III represents the PWM On Duty corresponding to the minimum off time. In the range of a duty ratio I (PWM On Duty is larger than 0% and less than the duty ratio H), the PWM On Duty and the PWM frequency are stored in association with each other so that the PWM frequency increases from fmin to fmax, with an increase of the PWM On Duty. Moreover, in the range of the duty ratio II to the duty ratio III, the PWM frequency is stored in such a manner that the largest frequency fmax is associated with the PWM On Duty. Furthermore, in the range of a duty ratio IV (the PWM On Duty is larger than the duty ratio III and less than 100%), the PWM On Duty and the PWM frequency are stored in association with each other, so that the PWM frequency decreases from fmax to fmin, with an increase of the PWM On Duty. As described above, in the present exemplary embodiment, if the duty ratio is divided into three ranges, in the range of the duty ratio I, the frequency variable unit 201 changes the PWM frequency while maintaining the on time at the minimum on time, in the range of the duty ratio II to the duty ratio III, changes the on time while fixing the PWM frequency, and in the range of the duty ratio IV, changes the PWM frequency while maintaining the off time at the minimum off time.

The PWM variable characteristics may be stored in the storage unit 202 by a mathematical expression. Moreover, the maximum frequency fmax may be approximately an integral multiple of the frequency of a synchronizing signal Vsync included in the image signal.

Here, an example in which the frequency variable unit 201 determines the time information to select the PWM frequency is described. As an example, a case where in the duty ratio II, the PWM On Duty is 10%, in the duty ratio III, the PWM On Duty is 90%, and the maximum frequency fmax of the PWM frequency is 20 [kHz] is described.

If the PWM On Duty, being the brightness information output by the brightness specifying unit 10, is 5%, the frequency variable unit 201 discriminates that the brightness information is in the range of the duty ratio I based on the PWM variable characteristics. The frequency variable unit 201 selects the PWM frequency corresponding to the PWM On Duty 5% based on the PWM variable characteristics. Furthermore, because the brightness information is in the range of the duty ratio I, the frequency variable unit 201 determines the on time to be the minimum on time stored in the storage unit 202.

Moreover, if the PWM On Duty, being the brightness information output by the brightness specifying unit 10, is 50%, the frequency variable unit 201 discriminates that the brightness information is in the range of the duty ratio II to the duty ratio HI based on the PWM variable characteristics. The frequency variable unit 201 selects the maximum frequency fmax as the PWM frequency based on the PWM variable characteristics. Furthermore, because the brightness information is in the range of the duty ratio II to the duty ratio III, the frequency variable unit 201 determines the on time to be the PWM On Duty 50% corresponding to the brightness information output by the brightness specifying unit 10.

Moreover, if the PWM On Duty, being the brightness information output by the brightness specifying unit 10, is 95%, the frequency variable unit 201 discriminates that the brightness information is in the range of the duty ratio IV based on the PWM variable characteristics. The frequency variable unit 201 selects the PWM frequency corresponding to the PWM On Duty 95%. Furthermore, because the brightness information is in the range of the duty ratio IV, the frequency variable unit 201 determines the off time to be the minimum off time stored in the storage unit 202.

Figure 5:
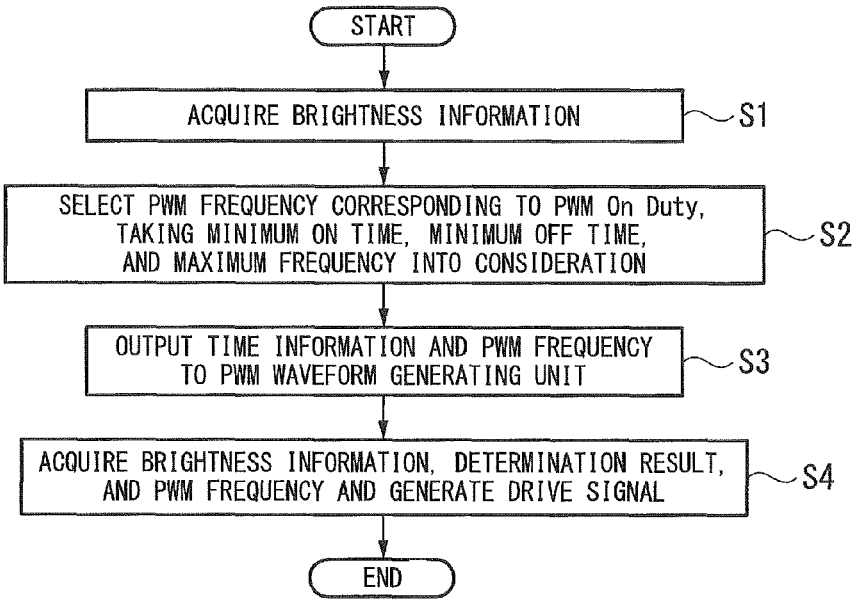
FIG. 5 is a flowchart showing a process procedure of the drive control unit according to the first exemplary embodiment.

A process procedure of the drive control unit 20 will be described next. FIG. 5 is a flowchart showing the process procedure of the drive control unit 20 according to the present exemplary embodiment.

(Step S1) The frequency variable unit 201 of the drive control unit 20 acquires the brightness information output by the brightness specifying unit 10.

(Step S2) The frequency variable unit 201 discriminates in which range of the duty ratio the acquired brightness information is, by using the PWM variable characteristics stored in the storage unit 202.

If the acquired brightness information is in the range of the duty ratio I, the frequency variable unit 201 determines, as the time information, the information indicating usage of the minimum on time as the on time, and selects the PWM frequency less than the maximum frequency fmax, based on the PWM variable characteristics stored in the storage unit 202.

Moreover, if the acquired brightness information is in the range of the duty ratio II to the duty ratio III, the frequency variable unit 201 determines, as the time information, the information indicating usage of the brightness information as the on time, and selects the PWM frequency as the maximum frequency fmax, based on the PWM variable characteristics stored in the storage unit 202.

Alternatively, if the acquired brightness information is in the range of the duty ratio IV, the frequency variable unit 201 determines, as the time information, the information indicating usage of the minimum off time as the off time, and selects the PWM frequency less than the maximum frequency fmax, based on the PWM variable characteristics stored in the storage unit 202.

(Step S3) The frequency variable unit 201 outputs the determined time information and the selected PWM frequency to the PWM waveform generating unit 203.

(Step S4) The PWM waveform generating unit 203 acquires the brightness information output by the brightness specifying unit 10, and acquires the time information and the PWM frequency output by the frequency variable unit 201. Then the PWM waveform generating unit 203 generates a drive signal based on the acquired time information and the PWM frequency, and outputs the generated drive signal to the drive unit 30.

If the time information is the information indicating usage of the minimum on time, the PWM waveform generating unit 203 generates a drive signal corresponding to the PWM frequency without using the brightness information output by the brightness specifying unit 10, while maintaining the minimum on time. Moreover, if the time information is the information indicating usage of the brightness information, the PWM waveform generating unit 203 generates a drive signal corresponding to the on time corresponding to the brightness information and the PWM frequency. Alternatively, if the time information is the information indicating usage of the minimum off time, the PWM waveform generating unit 203 generates a drive signal corresponding to the PWM frequency without using the brightness information output by the brightness specifying unit 10, while maintaining the minimum off time.

Figure 6:
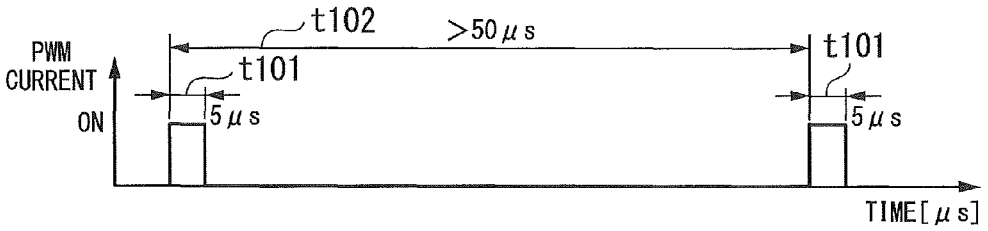
FIG. 6 is a diagram for explaining an example of a drive signal in a range of a duty ratio I in FIG. 4 according to the first exemplary embodiment.
Figure 7:
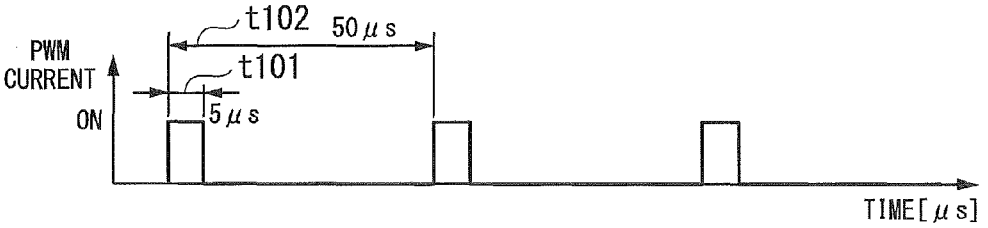
FIG. 7 is a diagram for explaining an example of a drive signal at a duty ratio II in FIG. 4 according to the first exemplary embodiment.
Figure 8:
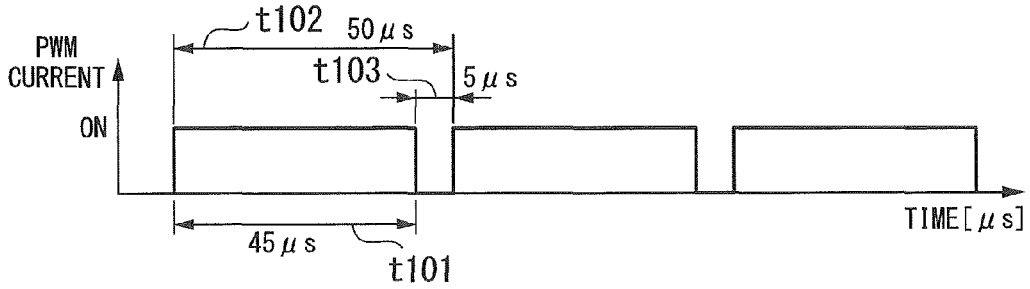
FIG. 8 is a diagram for explaining an example of a drive signal at a duty ratio III in FIG. 4 according to the first exemplary embodiment.
Figure 9:
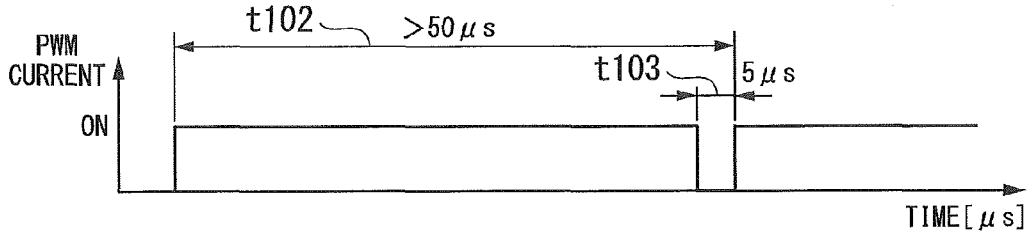
FIG. 9 is a diagram for explaining an example of a drive signal in a range of a duty ratio IV in FIG. 4 according to the first exemplary embodiment.

An example of an operation of the drive control unit 20 is described next with reference to FIG. 3, FIG. 4, and FIG. 6 to FIG. 9. FIG. 6 is a diagram for explaining an example of the drive signal in the range of the duty ratio I in FIG. 4 according to the present exemplary embodiment. FIG. 7 is a diagram for explaining an example of the drive signal in the range of the duty ratio II in FIG. 4 according to the present exemplary embodiment. FIG. 8 is a diagram for explaining an example of the drive signal in the range of the duty ratio III in FIG. 4 according to the present exemplary embodiment. FIG. 9 is a diagram for explaining an example of the drive signal in the range of the duty ratio IV in FIG. 4 according to the present exemplary embodiment. In FIG. 6 to FIG. 9, time is plotted on the horizontal axis, and the current level of the PWM drive signal is plotted on the vertical axis.

In the following description, a case where the minimum on time is 5 [μsec], the minimum off time is 5 [μsec], and the maximum frequency fmax of the PWM frequency is 20 [kHz] is described. Therefore, the duty ratio II corresponds to a duty ratio 10%, and the duty ratio III corresponds to a duty ratio 90%. The PWM cycle corresponding to a case where the maximum frequency fmax is 20 [kHz] is 50 [μsec].

In the case of FIG. 6, the frequency variable unit 201 discriminates that the acquired brightness information is in the range of the duty ratio I based on the PWM variable characteristics stored in the storage unit 202 (FIG. 4). Then the frequency variable unit 201 determines the time information based on the discrimination result, and selects the PWM frequency. Here, because the brightness information is in the range of the duty ratio I, the frequency variable unit 201 selects the PWM frequency (1/t102) so that the maximum frequency fmax is less than 20 [kHz] (=longer than 50 [μsec]) based on the PWM variable characteristics. Moreover, the frequency variable unit 201 determines the on time t101 to be 5 [μsec] being the minimum on time stored in the storage unit 202. Then the PWM waveform generating unit 203 maintains the minimum on time to be 5 [μsec] as shown in FIG. 6 corresponding to the time information and the PWM frequency output from the frequency variable unit 201, and generates a drive signal having the maximum frequency fmax of the PWM frequency of 20 [kHz].

For example, if the PWM On Duty being the brightness information is 5%, because the brightness information is in the range of the duty ratio I, the frequency variable unit 201 determines the on time t101 to be 5 [μsec] being the minimum on time stored in the storage unit 202. Moreover, the frequency variable unit 201 selects the PWM frequency to be 10 [kHz] (=100 [μsec]) based on the PWM variable characteristics stored in the storage unit 202. Thus, in the range of the duty ratio I, the frequency variable unit 201 decreases the maximum frequency fmax of the PWM frequency from 20 [kHz] to 10 [kHz] to increase the PWM cycle to be longer than 50 [μsec]. Thus, by decreasing the PWM frequency from 20 [kHz] to 10 [kHz], the duty ratio can be set to 5% while the minimum on time is maintained to be 5 [μsec]. As a result, in the range of the duty ratio I, the brightness can be decreased by decreasing the PWM frequency and decreasing the on time ratio more than for the case of the duty ratio II. Then the PWM waveform generating unit 203 maintains the minimum on time to be 5 [μsec], and generates a drive signal having the PWM frequency of 10 [kHz].

In the case of FIG. 7 and FIG. 8, the frequency variable unit 201 discriminates that the acquired brightness information is in the range of the duty ratios II to III based on the PWM variable characteristics stored in the storage unit 202. Then the frequency variable unit 201 determines the time information based on the discrimination result, and selects the PWM frequency. Here, because the brightness information is in the range of the duty ratios II to III, the frequency variable unit 201 selects the PWM frequency (1/t102) to be the maximum frequency fmax 20 [kHz] (=50 [μsec]) based on the PWM variable characteristics. Moreover, the frequency variable unit 201 determines the on time t101 to be the duty ratio corresponding to the brightness information. Then the PWM waveform generating unit 203 changes the on time corresponding to the brightness information to be from 5 [μsec] to 45 [μsec] as shown in FIG. 7 and FIG. 8, corresponding to the time information and the PWM frequency output from the frequency variable unit 201, and generates a drive signal having the maximum frequency fmax of the PWM frequency of 20 [kHz].

For example, as shown in FIG. 7, if the PWM On Duty being the brightness information is 10%, because the brightness information is in the range of the duty ratios II to III, the frequency variable unit 201 determines the on time t101 to be 5 [μsec] (=50 [μsec]×10%) being the on time corresponding to the brightness information. Moreover, the frequency variable unit 201 selects the PWM frequency having the maximum frequency fmax of 20 [kHz] (=50 [μsec]) based on the PWM variable characteristics stored in the storage unit 202. Then the PWM waveform generating unit 203 generates a drive signal having the on time corresponding to the brightness information of 5 [μsec], and having the maximum frequency fmax of the PWM frequency of 20 [kHz].

For example, as shown in FIG. 8, if the PWM On Duty being the brightness information is 90%, because the brightness information is in the range of the duty ratios II to III, the frequency variable unit 201 determines the on time t101 to be 45 [μsec] (=50 [μsec]×90%) being the on time corresponding to the brightness information. Moreover, the frequency variable unit 201 selects the PWM frequency to be the maximum frequency of 20 [kHz] (=50 [μsec]) based on the PWM variable characteristics stored in the storage unit 202. Then the PWM waveform generating unit 203 generates a drive signal having the on time corresponding to the brightness information of 95 [μsec], and having the maximum frequency fmax of the PWM frequency of 20 [kHz].

In the case of FIG. 9, the frequency variable unit 201 discriminates that the acquired brightness information is in the range of the duty ratio IV based on the PWM variable characteristics stored in the storage unit 202. Then the frequency variable unit 201 determines the time information based on the discrimination result, and selects the PWM frequency. Here, because the brightness information is in the range of the duty ratio IV, the frequency variable unit 201 selects the PWM frequency (1/t102) so that the maximum frequency fmax is less than 20 [kHz] (=longer than 50 [μsec]) based on the PWM variable characteristics. Moreover, the frequency variable unit 201 determines the off time t103 to be 5 [μsec] being the minimum off time stored in the storage unit 202. Then the PWM waveform generating unit 203 maintains the minimum off time to be 5 [μsec] as shown in FIG. 9, corresponding to the time information and the PWM frequency output from the frequency variable unit 201, and generates a drive signal having the maximum frequency fmax of the PWM frequency less than 20 [kHz].

For example, if the PWM On Duty being the brightness information is 95%, because the brightness information is in the range of the duty ratio IV, the frequency variable unit 201 determines the on time t103 to be 5 [μsec] being the minimum off time stored in the storage unit 202. Moreover, the frequency variable unit 201 selects the PWM frequency to be 10 [kHz] (=100 [μsec]) based on the PWM variable characteristics stored in the storage unit 202. Thus, also in the range of the duty ratio IV, the frequency variable unit 201 decreases the maximum frequency fmax of the PWM frequency from 20 [kHz] to 10 [kHz] to thereby increase the PWM cycle t102 to be longer than 50 bisect Thus, by decreasing the maximum frequency fmax of the PWM frequency from 20 [kHz] to 10 [kHz], the duty ratio can be set to 95% while the minimum off time is maintained to be 5 [μsec]. As a result, in the range of the duty ratio IV, the brightness can be increased by decreasing the PWM frequency and increasing the on time ratio more than for the case of the duty ratio III. Subsequently the PWM waveform generating unit 203 maintains the minimum off time to be 5 [μsec], and generates a drive signal having the PWM frequency of 10 [kHz].

As described above, the display device according to the present exemplary embodiment includes the drive control unit that, in the first range and the third range in which the ranges of the duty ratio of the drive signal, being the pulse signal for driving the light source of the backlight, are preset, changes the frequency of the drive signal based on the brightness of the light source, and in the second range in which the range of the duty ratio of the drive signal is preset, fixes the frequency of the drive signal to a predetermined frequency.

Moreover, in the display device according to the present invention, the drive control unit, in the first range, fixes the on time being a period during which the pulse in the drive signal is in the on state, and changes the frequency of the drive signal so as to be decreased to lower than the predetermined frequency based on the brightness of the light source; in the second range, changes the duty ratio of the drive signal based on the brightness; and in the third range, fixes the off time, being a period during which the pulse in the drive signal is in the off state, and changes the frequency of the drive signal so as to be decreased to lower than the predetermined frequency based on the brightness.

According to the configuration, in the display device 1 according to the present exemplary embodiment, if a user specifies brightness outside of the range drivable by the maximum frequency fmax of the PWM frequency, the drive unit 30 determines the PWM frequency to be less than maximum frequency fmax. Moreover, in the display device 1 according to the present exemplary embodiment, if the user specifies brightness outside of the range drivable by the maximum frequency fmax of the PWM frequency, the drive unit 30 determines the on time to be the minimum on time stored in the storage unit 202, or determines the off time to be the minimum off time stored in the storage unit 202. As a result, in the display device 1 according to the present exemplary embodiment, adjustment of the brightness can be performed even in the range of the duty ratios I and IV. Therefore display can be performed in a wider brightness range than that of the conventional technique. If the conventional adjustment range of the brightness is, for example, 20% to 80%, then according to the present exemplary embodiment, the adjustment range of the brightness can be extended to, for example, 0.2% to 98.8% as described below.

Figure 10:
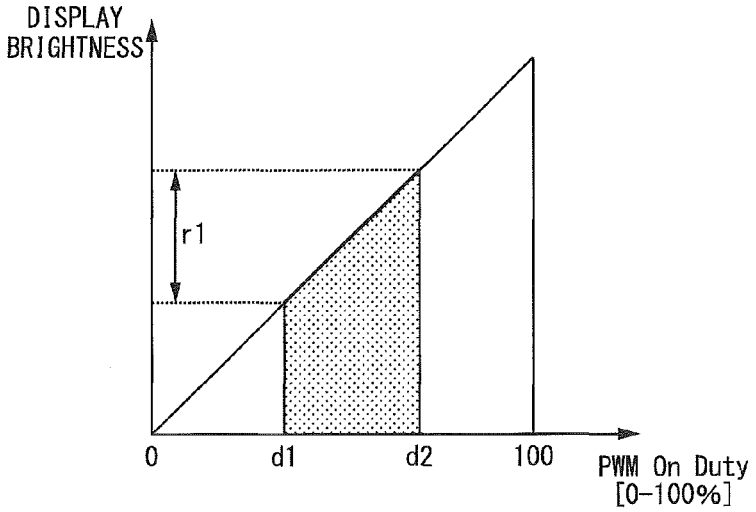
FIG. 10 is a diagram for explaining a relation between PWM On Duty and display brightness in a comparative example.
Figure 11:
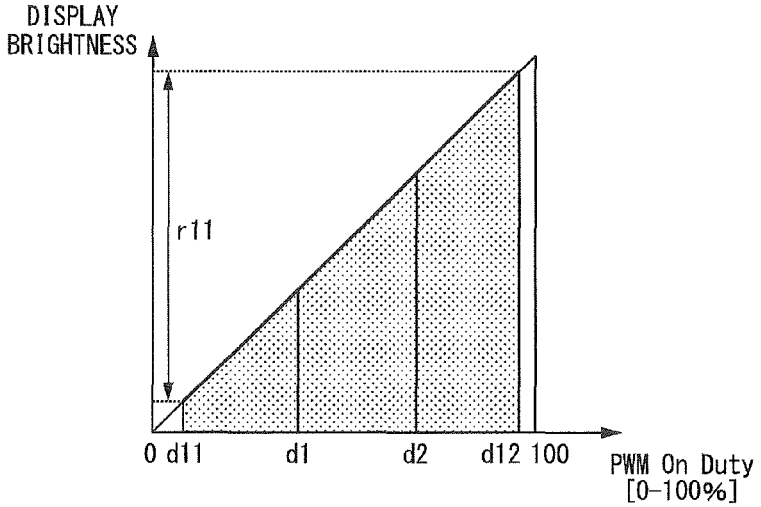
FIG. 11 is a diagram for explaining a relation between PWM On Duty and display brightness according to the first exemplary embodiment.

FIG. 10 is a diagram for explaining a relation between the PWM On Duty and the display brightness according to a comparative example. FIG. 11 is a diagram for explaining a relation between the PWM On Duty and the display brightness according to the present exemplary embodiment. In FIG. 10 and FIG. 11, the PWM On Duty is plotted on the horizontal axis and the display brightness is plotted on the vertical axis. FIG. 10 is an example of a range of the display brightness by a drive method according to the comparative example in which only the duty ratio is changed when the PWM frequency is fixed. FIG. 11 is an example of a range of the display brightness by the drive method according to the present exemplary embodiment. In FIG. 10 and FIG. 11, components constituting the drive unit 30 are the same.

In FIG. 10 and FIG. 11, a duty ratio d1 is a duty ratio determined by the minimum on time drivable by the components constituting the drive unit 30. Moreover, a duty ratio d2 is a duty ratio determined by the minimum off time drivable by the components constituting the drive unit 30. For example, the duty ratio d1 when the drive unit 30 is driven at the PWM frequency of 200 [Hz] is about 0.2% and the duty ratio d2 is about 99.8%. When the drive unit 30 is driven at the maximum frequency fmax of the PWM frequency of 20 [kHz] in order to reduce flicker and reduce audible band noise due to the drive signal, the PWM frequency is increased by a hundredfold. Therefore the duty ratio d1 becomes 20%, being a hundredfold the size of 0.2%, and the duty ratio d2 becomes 80% (=100-0.2×100) by subtracting a hundredfold of the size of 0.2% (=100-99.8). As shown in FIG. 10, in the comparative example, because the on time is too short in the range of the duty ratio 0% to d1, the drive unit 30 cannot generate a drive signal, and the display device 1 cannot perform brightness adjustment. Moreover, in the comparative example, because the off time is too short in the range of the duty ratio d2 to 100%, the drive unit 30 cannot generate a drive signal, and the display device 1 cannot perform brightness adjustment. Thus, in the comparative example, if the PWM frequency is increased to reduce flicker, the minimum on time and the minimum off time cannot be shortened in accordance therewith, and hence an adjustment range of the brightness becomes narrow.

On the other hand, in the present exemplary embodiment, if the drive unit 30 is driven at the maximum frequency fmax of the PWM frequency of 20 [kHz] in order to reduce flicker and reduce the audible band noise, the PWM frequency is changed while maintaining the on time of the duty ratio d1 in the range of the duty ratio I. Consequently, as shown in FIG. 11, according to the present exemplary embodiment, a range in which activation adjustment is possible can be extended from the duty ratio d1 to d11. Similarly, the PWM frequency is also changed while maintaining the off time of a duty ratio d12 in the range of the duty ratio IV. Consequently, as shown in FIG. 11, according to the present exemplary embodiment, the range in which activation adjustment is possible can be extended from the duty ratio d2 to d12. In other words, according to the present exemplary embodiment, PWM control is performed in the vicinity of the duty ratio being 50% by the duty ratio based on the brightness information specified by the user, and in the range in which the duty ratio includes a neighborhood of 0% or a neighborhood of 100%, control is performed so that the on time or the off time is fixed and the PWM frequency is changed.

For example, in a drive circuit of an LED lighting device, a drive voltage is converted from 5V to 3.3V and output. In the drive circuit, if the PWM frequency is increased to be higher than a predetermined frequency in order to reduce flicker, and the off time of the PWM waveform is shortened in order to increase the brightness, overvoltage may be supplied to the LED. Therefore, the PWM frequency cannot be changed in the vicinity of the duty ratio being 100%. On the other hand, in the present exemplary embodiment, the drive current or drive voltage to be used in the drive unit 30 is directly output to the backlight 40 without conversion. Therefore the PWM frequency can be changed even in the vicinity of the duty ratio being 100%.

Moreover, in a conventional method of changing the frequency by adjusting the duty ratio being the on time, the on time or the off time that can be driven is limited according to the specification of the component to be used for the drive unit 30. If the operation is performed in a higher frequency, the drive unit 30 needs to be constituted by an expensive component having high performance. On the other hand, according to the present exemplary embodiment, during the on time and the off time, the PWM frequency is changed to less than the maximum frequency fmax, while maintaining the time limited by the component. Therefore, the drive unit 30 can be constituted without using the expensive component. As a result, the cost of the display device 1 can be reduced.

In the present exemplary embodiment, an example has been described in which the frequency variable unit 201 discriminates whether the brightness information output by the brightness specifying unit 10 is in the range of the duty ratio I, the duty ratio II to III, or the duty ratio IV, and the PWM waveform generating unit 203 determines the on time or the off time to be used. However, it is not limited thereto. The PWM waveform generating unit 203 may perform such discrimination and determination based on the information stored in the storage unit 202.

Second Exemplary Embodiment

Figure 12:
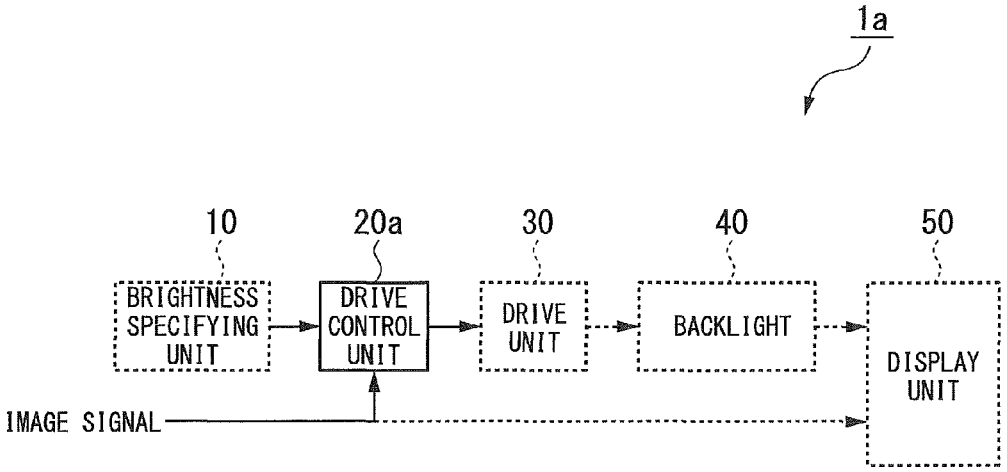
FIG. 12 is a block diagram of a schematic configuration of a display device according to a second exemplary embodiment.

FIG. 12 is a block diagram of a schematic configuration of a display device 1*a* according to the present exemplary embodiment. As shown in FIG. 12, the display device 1*a* includes a brightness specifying unit 10, a drive control unit 20*a*, a drive unit 30, a backlight 40, and a display unit 50. Components having a similar function to those of the display device 1 described in the first exemplary embodiment are denoted by the same reference symbols, and explanation thereof is omitted.

The drive control unit 20*a* generates a drive signal for the PWM drive, based on brightness information output by the brightness specifying unit 10 and a frequency of a synchronizing signal Vsync included in an image signal, and outputs the generated drive signal to the drive unit 30. The frequency of the synchronizing signal Vsync is, for example, 60 [Hz].

Figure 13:
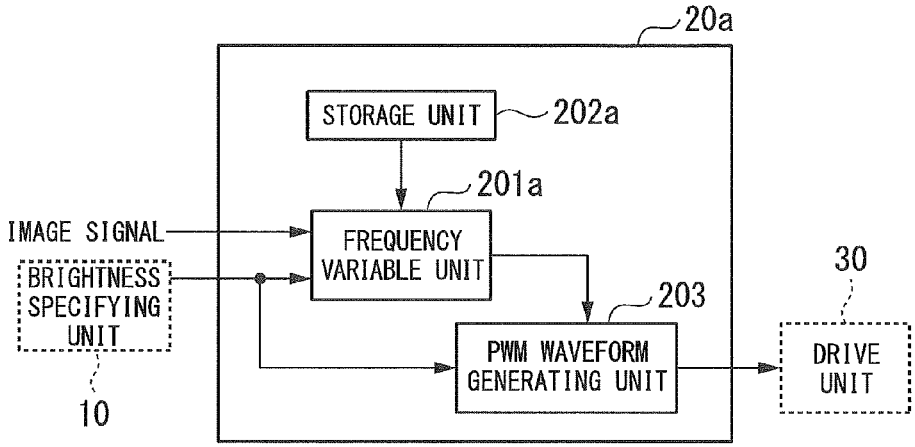
FIG. 13 is a block diagram of a schematic configuration of a drive control unit according to the second exemplary embodiment.

FIG. 13 is a block diagram of a schematic configuration of the drive control unit 20*a* according to the present exemplary embodiment. As shown in FIG. 13, the drive control unit 20*a* includes a frequency variable unit 201*a*, a storage unit 202, and a PWM waveform generating unit 203. Components having a similar function to those of the drive control unit 20 described in the first exemplary embodiment are denoted by the same reference symbols, and explanation thereof is omitted.

The frequency variable unit 201*a* acquires the brightness information output by the brightness specifying unit 10. The frequency variable unit 201*a* discriminates in which range of the duty ratio the acquired brightness information is, by using the PWM variable characteristics stored in the storage unit 202. The frequency variable unit 201*a* determines time information for generating the PWM waveform, based on a discrimination result, and outputs the determined time information to the PWM waveform generating unit 203.

The frequency variable unit 201*a* selects the PWM frequency, based on the PWM variable characteristics stored in the storage unit 202. After selection of the PWM frequency, the frequency variable unit 201*a* calculates the selected PWM frequency so as to be an integral multiple of the frequency of the synchronizing signal Vsync included in the image signal. The frequency variable unit 201*a* outputs the calculated PWM frequency to the PWM waveform generating unit 203.

Figure 14:
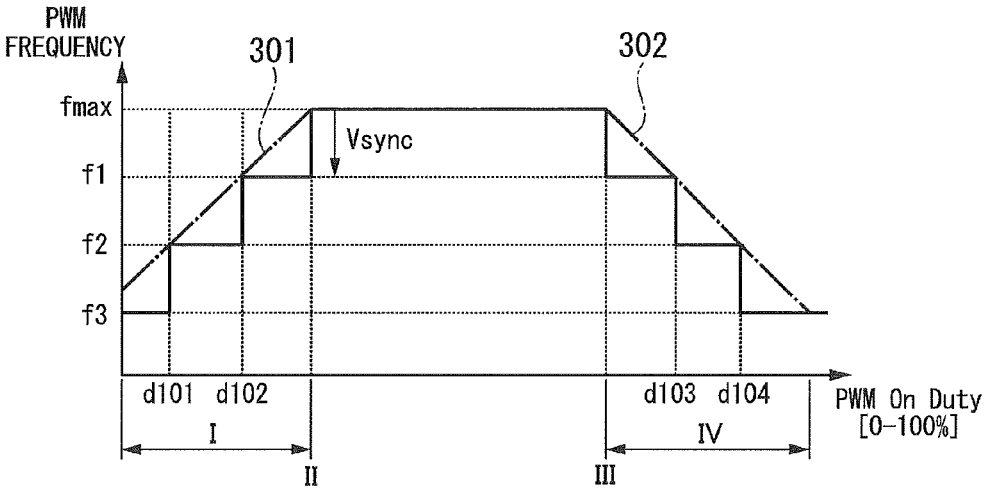
FIG. 14 is a diagram for explaining an example of selection and calculation of a PWM frequency performed by a frequency variable unit according to the second exemplary embodiment.

FIG. 14 is a diagram for explaining an example of selection and calculation of the PWM frequency, performed by the frequency variable unit 201*a* according to the present exemplary embodiment. In FIG. 14, the PWM On Duty is plotted on the horizontal axis, and the PWM frequency is plotted on the vertical axis. Moreover, in the PWM On Duty on the horizontal axis, the left side is 0% and the right side is 100%. The maximum frequency fmax is the integral multiple of the frequency of the synchronizing signal Vsync, in the case where the PWM frequency is equal to or less than a predetermined frequency. In the case where the PWM frequency is larger than the predetermined frequency, the maximum frequency fmax may not be the integral multiple of the frequency of the synchronizing signal Vsync. In the case where the maximum frequency fmax is the integral multiple of the frequency 60 [Hz] of the synchronizing signal Vsync, the maximum frequency fmax is, for example, 19.98 [kHz].

As shown in FIG. 14, in the range of the duty ratio I and the duty ratio IV, the PWM frequency is the integral multiple of the synchronizing signal Vsync with respect to the PWM On Duty. In the ranges of the duty ratio I and the duty ratio IV, if the PWM On Duty is between 0 and d101 or between d104 and 100, the PWM frequency is f3 (=fmax−Vsync×3). Moreover, if the PWM On Duty is between d101 and d102 or between d103 and d104, the PWM frequency is f2 (=fmax−Vsync×2). If the PWM On Duty is between d102 and II or between III and d103, the PWM frequency is f1 (=fmax−Vsync×1). As shown by one-dot chain lines 301 and 302 in FIG. 14, the PWM frequencies f1 to f3 are frequencies below a straight line indicating a change of the PWM frequency with respect to the PWM On Duty in the duty ratio I and the duty ratio IV in the PWM variable characteristics shown in FIG. 4.

The frequency variable unit 201*a* may pre-store a relation between the PWM On Duty and the PWM frequency shown in FIG. 14, to calculate the PWM frequency by using the stored relation so that the PWM frequency becomes the integral multiple of the frequency of the synchronizing signal Vsync. The relation between the PWM On Duty and the PWM frequency shown in FIG. 14 may be stored in the storage unit 202.

Here, an example of deter ruination of the time information and calculation of the PWM frequency performed by the frequency variable unit 201*a* is described.

For example, in the case where the PWM On Duty, being the acquired brightness information, is between d101 and d102, the frequency variable unit 201*a* discriminates that the acquired brightness information is in the range of the duty ratio I. Then the frequency variable unit 201*a* selects the PWM frequency corresponding to the brightness information in the range of the duty ratio I, based on the PWM variable characteristics shown in FIG. 4. In other words, the frequency variable unit 201*a* selects the PWM frequency above the one-dot chain line 301 in FIG. 14. Subsequently, the frequency variable unit 201*a* calculates the selected PWM frequency so as to be 12, being the integral multiple of the frequency of the synchronizing signal Vsync.

As another example, in the case where the PWM On Duty, being the acquired brightness information, is between III and d103, the frequency variable unit 201*a* discriminates that the acquired brightness information is in the range of the duty ratio IV. Then the frequency variable unit 201*a* selects the PWM frequency corresponding to the brightness information in the range of the duty ratio IV, based on the PWM variable characteristics shown in FIG. 4. In other words, the frequency variable unit 201*a* selects the PWM frequency above the one-dot chain line 302 in FIG. 14. Subsequently, the frequency variable unit 201*a* calculates the selected PWM frequency so as to be f1, being the integral multiple of the frequency of the synchronizing signal Vsync.

The example shown in FIG. 14 is an example only, and the PWM frequency in the range of the duty ratio I and the range of the duty ratio IV needs only to be the integral multiple of the frequency of the synchronizing signal Vsync. For example, the PWM frequency selected by the frequency variable unit 201*a* may be fmax−Vsync×1 in the case where the duty ratio is between d102 and II, and may be fmax−Vsync×3 in the case where the duty ratio is between d101 and d102. Moreover, the PWM frequency selected by the frequency variable unit 201*a* may be fmax−Vsync×2 in the case where the duty ratio is between III and d103, and may be fmax−Vsync×4 in the case where the duty ratio is between d103 and d104. Thus, the way of change in the PWM frequency in the range of the duty ratio I and the range of the duty ratio IV may be different respectively.

Thus, in the present exemplary embodiment, the frequency variable unit 201*a* calculates the PWM frequency so as to be the integral multiple of the frequency of the synchronizing signal Vsync, in the range less than the duty ratio II or in the range larger than the duty ratio III.

Figure 15:
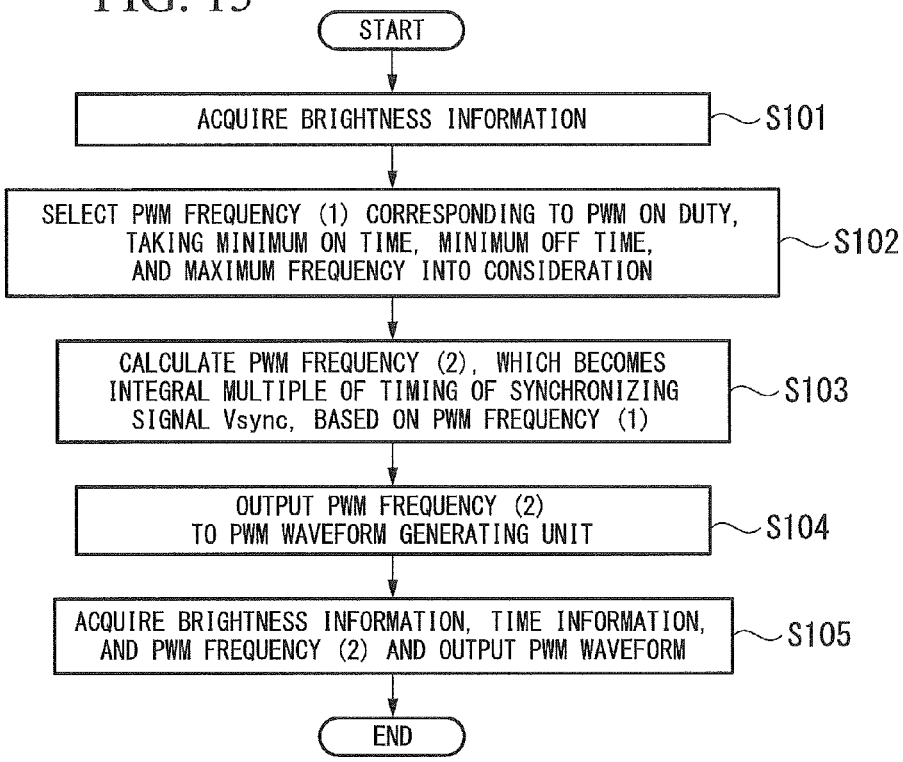
FIG. 15 is a flowchart showing a process procedure of the drive control unit according to the second exemplary embodiment.

A process procedure of the drive control unit 20*a* will be described next. FIG. 15 is a flowchart showing the process procedure of the drive control unit 20*a* according to the present exemplary embodiment.

(Step S101) The frequency variable unit 201*a* of the drive control unit 20*a* acquires the brightness information output by the brightness specifying unit 10.

(Step S102) The frequency variable unit 201*a* discriminates in which range of the duty ratio the acquired brightness information is, by using the PWM variable characteristics stored in the storage unit 202. The frequency variable unit 201*a* determines the time information, based on the discrimination result. Subsequently, the frequency variable unit 201*a* selects a PWM frequency (1) based on the PWM variable characteristics (FIG. 4) stored in the storage unit 202.

(Step S103) The frequency variable unit 201*a* discriminates whether the PWM frequency (1) selected in step S102 is the maximum frequency fmax. If the PWM frequency (1) is the maximum frequency fmax, the frequency variable unit 201*a* designates the PWM frequency (1) as a PWM frequency (2). If the PWM frequency is not the maximum frequency fmax, the frequency variable unit 201*a* calculates the PWM frequency (2), being the integral multiple of the frequency of the synchronizing signal Vsync included in the image signal.

(Step S104) The frequency variable unit 201*a* outputs the determined time information and the calculated PWM frequency (2) to the PWM waveform generating unit 203.

(Step S105) The PWM waveform generating unit 203 acquires the brightness information output by the brightness specifying unit 10, and acquires the time information and the PWM frequency (2) output by the frequency variable unit 201*a*. Subsequently, the PWM waveform generating unit 203 generates a drive signal based on the acquired time information and the PWM frequency (2), and outputs the generated drive signal to the drive unit 30.

As described above, in the display device according to the present exemplary embodiment, the drive control unit changes the frequency of the drive signal according to the frequency of the synchronizing signal included in the input image signal.

With this configuration, in the display device 1*a* according to the present exemplary embodiment, display can be performed in a wider brightness range than that of the conventional technique, as in the first exemplary embodiment. Moreover, in the present exemplary embodiment, because the PWM frequency is changed so as to be the integral multiple of the frequency of the synchronizing signal Vsync, interference noise with the image signal can be reduced.

In the present exemplary embodiment, an example of calculating the PWM frequency so as to be the integral multiple of the frequency of the synchronizing signal Vsync in all the ranges of the duty ratio I and the duty ratio IV has been described. However, it is not limited thereto. If the PWM frequency is less than the predetermined frequency, the frequency variable unit 201*a* calculates the PWM frequency so as to be the integral multiple of the frequency of the synchronizing signal Vsync. If the PWM frequency is equal to or larger than the predetermined frequency, the selected PWM frequency can be directly used without calculating the PWM frequency so as to be the integral multiple of the frequency of the synchronizing signal Vsync. Thus, the reason the PWM frequency need not be calculated if the PWM frequency is equal to or larger than the predetermined frequency is that the user does not feel flickers if the PWM frequency becomes high. Consequently, the predetermined frequency can be pre-determined by experiments.

In the first and second exemplary embodiments, an example of dividing the duty ratio into three ranges to perform control for each range has been described. However, it is not limited thereto. The range may be three or more. For example, as described in the second exemplary embodiment, if the PWM frequency is changed so as to become the integral multiple of the frequency of the synchronizing signal Vsync, the duty ratio may be divided into five ranges.

Figure 16:
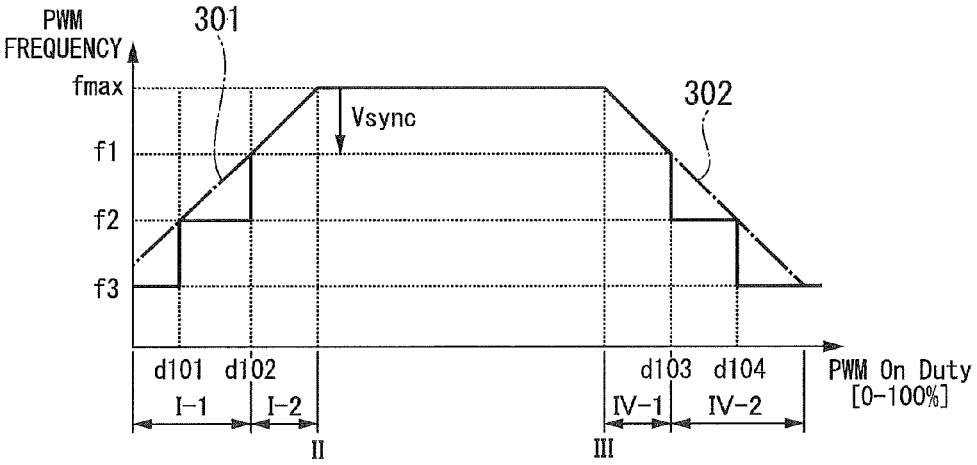
FIG. 16 is a diagram for explaining an example of a relation between PWM On Duty and PWM frequency when the duty ratio is divided into five ranges.

FIG. 16 is a diagram for explaining an example of the relation between the PWM On Duty and the PWM frequency when the duty ratio is divided into five ranges. In FIG. 16, the PWM On Duty in the PWM waveform is plotted on the horizontal axis, and the PWM frequency is plotted on the vertical axis.

For example, a first range is a range of a duty ratio I-1 shown in FIG. 16, which is a range where the PWM On Duty is from 0 to d102, that is, the duty ratio is near 0% and the PWM frequency is less than a predetermined frequency. In the first range, the frequency variable unit 201*a* may fix the on time to the minimum on time, and calculate the PWM frequency so as to be the integral multiple of the frequency of the synchronizing signal Vsync.

A second range is a range of a duty ratio I-2, which is a range where the PWM On Duty is from d102 to III, that is, the duty ratio is near 0% and the PWM frequency is equal to or larger than the predetermined frequency. In the second range, the frequency variable unit 201*a* may fix the on time to the minimum on time, and change the PWM frequency.

A third range is a range of from the duty ratio II to a duty ratio III, that is, a range including a neighborhood of 50% of the duty ratio, with the PWM frequency being in the range of the maximum frequency fmax. In the third range, the frequency variable unit 201*a* may change the on time according to the brightness information, and fix the PWM frequency.

A fourth range is a range of a duty ratio IV-1, which is a range where the PWM On Duty is from III to d103, that is, a range where the duty ratio is near 100% and the PWM frequency is equal to or larger than the predetermined frequency. In the fourth range, the frequency variable unit 201*a* may fix the off time to the minimum off time, and change the PWM frequency.

A fifth range is a range of a duty ratio IV-2, which is a range where the PWM On Duty is from d104 to 100, that is, the duty ratio is near 100% and the PWM frequency is less than the predetermined frequency. In the fifth range, the frequency variable unit 201*a* may fix the off time to the minimum off time, and calculate the PWM frequency so as to be the integral multiple of the frequency of the synchronizing signal Vsync.

In the first and second exemplary embodiments, an example has been described in which a white LED is used for the backlight 40 as the light source, but the light source is not limited thereto. In the backlight 40, white light can be generated by mixing LED lights of three light sources such as red LED, green LED, and blue LED. In this case, the drive unit 30 may have a drive unit for each red LED, green LED, and blue LED. Then if the duty ratio is less than the minimum on time or less than the minimum off time, the drive control unit 20 (including 20*a*) may select a PWM frequency with respect to the respective colors according to the brightness information output by the brightness specifying unit 10. Then the drive control unit 20 (including 20*a*) may output the selected PWM frequency for each color to the drive unit 30.

In the first and second exemplary embodiments, an example has been described in which the frequency variable unit 201 (including 201*a*) selects the PWM frequency. However, it is not limited thereto. The frequency variable unit 201 (including 201*a*) may select the time of the PWM cycle corresponding to the PWM frequency, or may calculate the PWM frequency so as to be the integral multiple of the time corresponding to the cycle of the synchronizing signal Vsync.

As described above, in the present invention, an example has been described in which the drive control unit 20 (including the drive control unit 20*a*) is used for control of the backlight of the display device 1 (including 1*a*). However, the present invention is not limited thereto. The drive control unit 20 (including 20*a*) may be used for control of a light source such as a projector or a laser TV. Moreover, the display device 1 (including 1*a*) in the present exemplary embodiment may be applied to a personal digital assistance, a navigation system, an advertisement indicator lamp, a digital signage, and the like.

A program for realizing the functions of the drive control unit 20 in FIG. 1 and FIG. 3, or the drive control unit 20*a* in FIG. 12 and FIG. 13 of the present exemplary embodiment may be recorded in a computer readable recording medium, and the program recorded in the recording medium may be read and executed by a computer system, thereby performing the respective processes of the respective units. The "computer system" referred to herein includes hardware such as an OS and a peripheral device.

Moreover, if a WWW system is used, the "computer system" includes a website providing environment (or a display environment).

Furthermore, "computer readable recording medium" stands for portable media such as a flexible disk, a magnetooptic disk, a ROM (Read Only Memory), and a CD-ROM, or a storage device such as an USB (Universal Serial Bus) memory connected via an USB I/F (interface), a hard disk or the like incorporated in the computer system. Furthermore, the "computer readable recording medium" includes a medium that holds a program for a certain period of time such as a volatile memory in the computer system, which becomes a server or a client. Moreover, the above program may realize a part of the functions described above, and may realize the functions described above in combination with a program recorded beforehand in the computer system.

REFERENCE SYMBOLS

1, 1*a* Display device
10 Brightness specifying unit

20, 20*a* Drive control unit
30 Drive unit
40 Backlight
50 Display unit
201, 201*a* Frequency variable unit
202 Storage unit
203 PWM waveform generating unit

The invention claimed is:

1. A display device, comprising:

a drive controller that changes a frequency of a drive signal based on a brightness of a light source of a backlight when a duty ratio of the drive signal is in a first range or is in a third range, the drive signal including a pulse signal for driving the light source, the drive controller fixing the frequency of the drive signal to a predetermined frequency when the duty ratio of the drive signal is in a second range, wherein the drive controller is configured to:

fix an on time and change the frequency of the drive signal so as to be lower than the predetermined frequency based on the brightness of the light source when the duty ratio of the drive signal is in the first range, the on time including a period during which a pulse in the drive signal is in an on state;

change the duty ratio of the drive signal based on the brightness when the duty ratio of the drive signal is in the second range; and fix an off time and change the frequency of the drive signal so as to be lower than the predetermined frequency based on the brightness when the duty ratio of the drive signal is in the third range, the off time including a period during which the pulse in the drive signal is in an off state.

2. The display device according to claim 1, wherein the duty ratio in the first range is less than the duty ratio in the second range, and wherein the duty ratio in the third range is larger than the duty ratio in the second range.

3. The display device according to claim 1, wherein the drive controller changes the frequency of the drive signal according to a frequency of a synchronizing signal included in an input image signal.

4. A display device, comprising:

a drive controller that changes a frequency of a drive signal based on a brightness of a light source of a backlight when a duty ratio of the drive signal is in a first range or is in a third range, the drive signal including a pulse signal for driving the light source, the drive controller fixing the frequency of the drive signal to a predetermined frequency when the duty ratio of the drive signal is in a second range, wherein the first range includes a range in which the duty ratio of the drive signal includes a neighborhood of 0%, wherein the second range includes a range in which the duty ratio of the drive signal includes a neighborhood of 50%, and wherein the third range includes a range in which the duty ratio of the drive signal includes a neighborhood of 100%.

5. A display device, comprising:

a drive controller that changes a frequency of a drive signal based on a brightness of a light source of a backlight when a duty ratio of the drive signal is in a first range or is in a third range, the drive signal including a pulse signal for driving the light source, the drive controller fixing the frequency of the drive signal to a predetermined frequency when the duty ratio of the drive signal is in a second range, wherein an on time includes a period during which a pulse in the drive signal is in an on state, wherein an off time includes a period during which the pulse in the drive signal is in an off state, and wherein the drive controller is configured to:

fix the on time to a minimum on time of a drive circuit that drives the drive signal when the duty ratio of the drive signal is in the first range; and fix the off time to a minimum off time of the drive circuit when the duty ratio of the drive signal is in the third range.

6. A display device control method, comprising:

changing a frequency of a drive signal based on a brightness of a light source of a backlight when a duty ratio of the drive signal is in a first range or is in a third range, the drive signal including a pulse signal for driving the light source; and fixing the frequency of the drive signal to a predetermined frequency when the duty ratio of the drive signal is in a second range, wherein the changing the frequency of the drive signal includes:

fixing an on time and changing the frequency of the drive signal so as to be lower than the predetermined frequency based on the brightness of the light source when the duty ratio of the drive signal is in the first range, the on time including a period during which a pulse in the drive signal is in an on state; and fixing an off time and changing the frequency of the drive signal so as to be lower than the predetermined frequency based on the brightness when the duty ratio of the drive signal is in the third range, the off time including a period during which the pulse in the drive signal is in an off state, and wherein the fixing the frequency of the drive signal includes changing the duty ratio of the drive signal based on the brightness when the duty ratio of the drive signal is in the second range.

7. A display device control method, comprising:

changing a frequency of a drive signal based on a brightness of a light source of a backlight when a duty ratio of the drive signal is in a first range or is in a third range, the drive signal including a pulse signal for driving the light source; and fixing the frequency of the drive signal to a predetermined frequency when the duty ratio of the drive signal is in a second range, wherein the first range includes a range in which the duty ratio of the drive signal includes a neighborhood of 0%, wherein the second range includes a range in which the duty ratio of the drive signal includes a neighborhood of 50%, and wherein the third range includes a range in which the duty ratio of the drive signal includes a neighborhood of 100%.

8. A display device control method, comprising:

changing a frequency of a drive signal based on a brightness of a light source of a backlight when a duty ratio of the drive signal is in a first range or is in a third range, the drive signal including a pulse signal for driving the light source; and fixing the frequency of the drive signal to a predetermined frequency when the duty ratio of the drive signal is in a second range, wherein an on time includes a period during which a pulse in the drive signal is in an on state, wherein an off time includes a period during which the pulse in the drive signal is in an off state, and wherein the changing the frequency of the drive signal includes:

fixing the on time to a minimum on time of a drive circuit that drives the drive signal when the duty ratio of the drive signal is in the first range; and fixing the off time to a minimum off time of the drive circuit when the duty ratio of the drive signal is in the third range.

* * * * *